United States Patent [19]

Herbstman et al.

[11] Patent Number: 4,964,879

[45] Date of Patent: Oct. 23, 1990

[54] MIDDLE DISTILLATE FUEL CONTAINING DEPOSIT INHIBITOR

[75] Inventors: Sheldon Herbstman, New City; Kashmir S. Virk, Hopewell Junction, both of N.Y.

[73] Assignee: Texaco Inc., White Plains, N.Y.

[21] Appl. No.: 329,035

[22] Filed: Mar. 27, 1989

[51] Int. Cl.[5] ..... C10L 1/18; C10L 1/22

[52] U.S. Cl. ..... 44/434

[58] Field of Search ..... 44/72, 57; 564/504, 564/505

[56] References Cited

U.S. PATENT DOCUMENTS

| | | | |
|---|---|---|---|
| 3,115,400 | 12/1963 | Marsh et al. | 44/72 |
| 3,231,619 | 1/1966 | Speranza | 564/505 |
| 3,440,029 | 4/1969 | Little et al. | 44/72 |
| 3,849,083 | 11/1974 | Dubeck | 44/72 |
| 3,960,965 | 6/1976 | Battersby et al. | 44/72 |
| 3,980,450 | 9/1976 | Battersby et al. | 44/72 |
| 4,392,867 | 7/1983 | Sung et al. | 564/505 |
| 4,444,566 | 4/1984 | Crawford et al. | 44/72 |
| 4,526,587 | 7/1985 | Campbell | 44/72 |
| 4,527,996 | 7/1985 | Campbell | 44/72 |
| 4,604,103 | 8/1986 | Campbell | 44/72 |
| 4,609,377 | 9/1986 | Sung et al. | 44/72 |
| 4,664,676 | 5/1987 | Denis et al. | 44/72 |
| 4,746,328 | 5/1988 | Sakamoto et al. | 44/72 |

FOREIGN PATENT DOCUMENTS

| | | | |
|---|---|---|---|
| 8500827 | 2/1985 | PCT Int'l Appl. | 44/72 |

*Primary Examiner*—Olik Chaudhuri
*Assistant Examiner*—Ellen M. McAvoy
*Attorney, Agent, or Firm*—Robert A. Kulason; James J. O'Loughlin; Carl G. Seutter

[57] ABSTRACT

Deposits in fuel injectors of diesel engines may be decreased by addition to diesel fuel of an ether primary amine.

13 Claims, No Drawings

MIDDLE DISTILLATE FUEL CONTAINING DEPOSIT INHIBITOR

FIELD OF THE INVENTION

This invention relates to middle distillate fuel oils. More particularly it relates to a diesel fuel characterized by its ability to decrease deposit formation in diesel fuel injectors.

BACKGROUND OF THE INVENTION

As is well known to those skilled in the art, middle distillate fuels typified by diesel oil, fuel oils, kerosene, etc may be burned to produce heat and/or power. Typically this is carried out by injecting the fuel into a combustion chamber through a fuel injector (in the case of a diesel engine) or a burner nozzle (in the case of a jet engines or a steam generating plant).

It is found that the small passageways in the injectors or nozzles in due course become plugged due to deposits which collect therein. These deposits may include solids formed as by reaction of diesel fuel with the metal in the injector or nozzle, or by pyrolytic effects in the nozzle or injector arising from the heat of combustion in the engine or the furnace chamber.

These deposits are clearly undesirable. They may result in uneven spray pattern leading to inefficient combustion and in the worst case scenario may totally block passage of oil to the point of combustion. As a practical matter, plugging of injectors and nozzles is correlative with and is measured by an increase in black smoke in the exhaust or stack gas.

Typical of prior art attempts to solve this or related problem may be noted the following patents:

U.S. Pat. No. 4,549,884 to Texaco Inc. as assignee of A. M. Mourao discloses use as a fuel additive of a monoalkoxylated nonyl phenol.

U.S. Pat. No. 4,460,379 to Texaco Inc. as assignee of W. M. Sweeney, R. L. Sunq, and W. C. Crawford discloses use as fuel additive of oxyethylene, oxypropylene tertiary amines as additives to stabilize fuels against sediment formation.

U.S. Pat. No. 4,689,051 to Texaco Inc. as assignee of Rodney L. Suno discloses diesel oil stabilized by addition of the reaction product of an alkyl polyoxyethylene polyoxypropyleneamine, maleic acid anhydride, and an N-alkyl alkylene diamine.

U.S. Pat. No. 4,444,566 to Texaco Inc. as assignee of W. C. Crawford et al discloses diesel oil stabilized by addition of an alpha, omega diamino poly(oxypropylene) poly(oxyethylene) poly(oxypropylene).

U.S. Pat. No. 4,482,354 to Texaco Inc. as assignee of William M. Sweeney, and Rodney L. Sung, Wheeler C. Crawford discloses middle distillates extended with shale oil containing (alkylpolyoxyalkyl)amino alkanoic acids.

U.S. Pat. No. 4,239,497 to UOP as assignee of G. W. Y. Kwong discloses hydrocarbon oils stabilized against sedimentation by addition of the reaction product of a poly(oxyalkylene) amine with an epichlorohydrin.

It is an object of this invention to provide a middle distillate fuel characterized by its ability to decrease deposit formation. It is a particular object of this invention to provide a diesel fuel characterized by decreased deposit formation in fuel injectors. Other objects will be apparent to those skilled in the art.

STATEMENT OF THE INVENTION

In accordance with certain of its aspects, this invention is directed to a middle distillate fuel oil composition characterized by its ability to decrease deposit formation in passageways through which it passes which comprises (i) a major portion of a hydrocarbon fuel oil boiling in the middle distillate fuel oil boiling range; and (ii) a minor deposit-inhibiting portion of, as a deposit-inhibiting additive, an ether mono-primary amine of molecular weight $\overline{M}_n$ of 200–400.

In accordance with certain of its other aspects, this invention is directed to a diesel fuel oil composition characterized by its ability to decrease deposit formation in diesel fuel injectors which comprises (i) a major portion of a hydrocarbon fuel oil boiling in the diesel fuel oil boiling range; and (ii) a minor deposit-inhibiting portion of, as deposit-inhibiting additive.

$$R(OCH_2-CH_2)_x-(OCH_2-\underset{\underset{R^*}{|}}{CH})_y-NH_2$$

wherein

R is an alkyl group having 1–20 carbon atoms;

x is 0–20;

y is 0–10; and the sum of x and y is 1–30.

R* is hydrogen or a lower alkyl group having 1–6 carbon atoms.

DESCRIPTION OF THE INVENTION

The middle distillate fuels which may be employed in practice of the process of this invention may typically include those having an ibp of 300° F. –450° F., say 369° F.; a 50% bp of 400° F. –550° F., say 496° F.; a 90% bp of 475° F. –625° F., say 586° F.; an EP of 500° F. –650° F., say 627° F.; and an API Gravity of 25–45, say 37.3. These fuels may commonly be labelled as kerosene, fuel oil, diesel oil, D-1 fuel, D-2 fuel, etc.

A preferred middle distillate charge may be a diesel oil having the following properties:

TABLE

| Property | Value |
|---|---|
| API Gravity D-1298 | 37.3 |
| Kin Vis. cSt @ 40° C. D-445 | 2.27 |
| Cetane D-613 | 49.6 |
| Distillation D-86 (°F.) | |
| IBP | 369 |
| 50% | 496 |
| 90% | 586 |
| EP | 627 |

Another charge may be a middle distillate fuel oil having the following typical characteristics.

TABLE

| Property | Value |
|---|---|
| API Gravity D-1298 | 43.0 |
| Kin. Vis. cSt @ 40° C. -D445 | 1.57 |
| Cetane D-613 | 47 |
| Distillation D-86 (°F.) | |
| IBP | 344 |
| 50% | 429 |
| 90% | 490 |
| EP | 524 |

It is a feature of the process of this invention that it may be possible to decrease the formation of deposits in passageways through which the oil passes (such as diesel fuel injectors) by addition thereto of a minor deposit-inhibiting amount of 10–300 PTB, preferably 30–100 PTB, say 60 PTB of an ether mono-primary amine of molecular weight $\overline{M}_n$ of 200–400, preferably 250–300, say 300. (PTB stands for pounds per thousand barrels).

The ether mono-primary amine (also called a mono ether primary amine or a poly(oxyalkylene) mono-primary amine) may be characterized by the formula $$R-(OCH_2CH_2)_x-(OCH_2\underset{\underset{R^*}{|}}{CH})_yNH_2$$

wherein

R is an alkyl group having 1–40, preferably 10–12, carbon atoms;

R* is hydrogen or a lower alkyl group having 1–6 carbon atoms;

x is 0–20 ; and y is 0–10; and the sum of x and y is 1–30

In the above formula x may be 0–20 and y may be 0–10. It will be apparent that when x is 0 (and y is 1–10), the formula may be:

$$R(OCH_2\underset{\underset{R^*}{|}}{CH})_yNH_2$$

and typically $(C_{10}-C_{12})-(OCH_2\underset{\underset{R^*}{|}}{CH})_2NH_2$

When y is 0 (and x is 1–20), the formula maybe $R(OCH_2CH_2)_x NH_2$

R* may be hydrogen or a lower alkyl group having 1–6 carbon atoms typified by methyl, ethyl, n-propyl, i-propyl, etc. R* is preferably methyl.

R may be an alkyl group containing 1–40, preferably 8–16, say 10–12 carbon atoms. R may be methyl, ethyl, n-propyl, i-propyl, butyls, amyls, hexyls, octyls, decyls, dodecyls, etc. R may preferably be a mixture of alkyl groups containing 10–12 carbon atoms—derived from the compound $RNH_2$ which is typically alkoxylated to yield the ether mono-primary amine.

In the above formula, R is preferably a mixture of alkyl groups containing 10–12 carbon atoms, y is 2–4, and x is 0.

These poly(oxyalkylene) mono primary amine compositions may be commercially available under the Jeffamine trademark of Texaco Inc. They are characterized by the presence of one nitrogen atom per molecule - as a terminal primary amine. Typical of such products are the following, the first listed being preferred:

TABLE

A. The Jeffamine M-300 brand of alkyl ether amine of molecular weight $\overline{M}_n$ od ca 300 having the following formula:

$$(C_{10}-C_{12}\text{ alkyl})\ (OCH_2\underset{\underset{CH_3}{|}}{CH})_2NH_2$$

B. The Jeffamine M-300 brand of alkyl ether amine of molecular weight $\overline{M}_n$ od ca 360 having the following formula:

TABLE-continued $$n\text{-}C_4H_9\ (OCH_2CH_2)_4\ (OCH_2-\underset{\underset{CH_3}{|}}{CH})_2NH_2$$

The ability of the systems of this invention to maintain the cleanliness of diesel fuel injectors is determined by the CLR Single Cylinder Engine Injector Deposit Test in which the smoke output (by the Bosch Test) is measured; smoke output in this test is found to be correlative with injector cleanliness.

In this CLR Test, the engine power, exhaust smoke, and other engine operating conditions are monitored as a function of time. Changes in the exhaust smoke in particular are considered to be a measure of the effectiveness of a test additive with respect to ability to keep the diesel fuel injector clean.

In preparation for this test, the disassembled injector nozzle, needle, and other interior parts are cleaned in an ultrasonic cleaner using the Citrikleen HD brand of cleaning solution. After all carbonacous matter is removed, the injector is reassembled and the valve opening pressure is set at 1200 psig. After inspection to ensure that the spray pattern is satisfactory and that back leakage is satisfactory, the injector is installed in the CLR test engine which is a naturally aspirated, direct injection type with a "Mexican" head type combustion chamber, single cylinder, engine.

During the test, the engine is operated as follows:

TABLE

| Variable | Value |
|---|---|
| Engine Speed (RPM) | 1600 |
| Fuel Rate (lbs/hr) | 3.0 |
| Air Rate (SCFM) | 20.0 |
| (lbs/mm) | 1.511 |
| Air:Fuel Ratio | 30.2 |
| Injection Timing (BTDC) | 8.5 |
| Intake Air Temp °F. | 122 |
| Jacket Temp | 176 |

The smoke is measured by the standard Bosch Test in which a predetermined volume of exhaust gas is passed through a filter; and the filter paper bearing the solids from the gas is rated on a standard scale which measures the amount of deposit which correlates with the intensity of the smoke.

In this standard Bosch Test, the rating is generally in the 0–5 region; and lower ratings indicate a desirable decrease in smoke output—evidencing higher degrees of injector cleanliness.

Illustrative formulations which may be employed in practice of this invention may include the following:

TABLE

I. 60 PTB of the Jeffamine M-300 brand of ether mono-primary amine in a diesel fuel having the following properties:

| Property | Value |
|---|---|
| API Gravity D-1298 | 37.3 |
| Kin. Vis. cSt @ 40° C. D-445 | 2.27 |
| Cetane D-613 | 49.6 |
| Distillation D-86 (°F.) | |
| IBP | 369 |
| 50% | 496 |
| 90% | 586 |
| EP | 627 |

II. 100 PTB of the Jeffamine M-360 brand of ether mono-primary amine in a No 2 fuel oil having the following properties:

| Property | Value |
|---|---|

TABLE-continued

| | | |
|---|---|---|
| | API Gravity D-1298 | 35.7 |
| | Kin Vis. cSt @ 40° C. D-445 | 2.40 |
| | Cetane D-613 | 44.7 |
| | Distillation D-86 (°F.) | |
| | IBP | 388 |
| | 50% | 510 |
| | 90% | 596 |
| | EP | 653 |
| III. | 80 PTB of the Jeffamine M-300 brand of ether mono-primary amine in a kerosene having the following properties: | |
| | Property | Value |
| | API Gravity D-1298 | 43.0 |
| | Kin. Vis. cSt @ 40° C. D-445 | 1.57 |
| | Cetane D-613 | 47 |
| | Distillation - D-86° F. | |
| | IBP | 344 |
| | 50% | 429 |
| | 90% | 490 |
| | EP | 524 |
| IV. | 75 PTB of the Jeffamine M-360 brand of ether mono-primary amine in a diesel fuel having the following properties: | |
| | Property | Value |
| | API Gravity D-1298 | 32.8 |
| | Kin. Vis. cSt @ 40° C. -D445 | 2.22 |
| | Cetane D-613 | 42.2 |
| | Distillation D-86 (°F.) | |
| | BP | 356 |
| | 50% | 495 |
| | 90% | 610 |
| | EP | 640 |

DESCRIPTION OF SPECIFIC EMBODIMENTS

Practice of this invention will be apparent to those skilled in the art from the following wherein, as elsewhere in this specification, all parts are parts by weight unless otherwise set forth. A Control Example is designated by an asterisk.

EXAMPLE I

In this Example which represents the best mode presently known of carrying out this invention, there is added to the diesel fuel composition I of the above Table (the Base Fuel) 60 PTB (parts by weight per thousand barrels) of the Jeffamine M-300 brand of alkyl ether amine of molecular weight $\overline{M}_n$ of ca 300 having the following formula:

$$(C_{10}-C_{12})-(OCH_2\underset{\underset{CH_3}{|}}{C}H)_2NH_2$$

There is also added to the Base Fuel 0.5w% of a known standard deposit-forming residual oil in an attempt to duplicate the least favorable conditions of operation for deposit formation in a diesel injector nozzle.

The smoke is measured at regular intervals over the extended test time. The Smoke-Bosch Reading as a function of Time is determined. Results are as tabulated below.

EXAMPLE II*

In this control Example II*, the Base Fuel of Example I plus the 0.5 w% residual oil is subjected to the same test.

TABLE

| Smoke-Bosch Reading @ Hours | EXAMPLE I | EXAMPLE II* |
|---|---|---|
| 0 | 1.5 | 1.5 |
| 15 | 1.7 | 2.2 |
| 30 | 2.1 | 2.7 |
| 45 | 2.4 | 3.4 |
| 60 | 2.7 | 3.9 |
| 75 | 3.1 | 4.6 |

From the above Table, it is apparent that the technique of this invention permits attainment of unobvious results. For example, the composition of Example I showed a rating of about 2.7 after 60 hours; in contrast to the composition of control Example II* which showed a rating of about 3.9 after 60 hours.

This improvement of 31% (1.2/3.9) represents a significantly decreased smoke output which is attained by use of the Jeffamine M-300 ether mono-primary amine additive to a diesel fuel.

Results comparable to those attained in Example I may be attained if the ether mono-primary amine is:

EXAMPLE III

The Jeffamine M-360 brand of alkyl ether amine of molecular weight $\overline{M}_n$ of ca 360 having the following formula:

$$n\text{-}C_4H_9(OCH_2CH_2)_4(OCH_2-\underset{\underset{CH_3}{|}}{C}H)_2NH_2$$

Results comparable to those of Example I may be attained if the middle distillate is:

TABLE

| EXAMPLE | MIDDLE DISTILLATE |
|---|---|
| IV | Middle Distillate No 2 Fuel |
| V | Kerosene |
| VI | Gas Oil |

Although this invention has been illustrated by reference to specific embodiments, it will be apparent to those skilled in the art that various charges and modifications may be made which clearly fall within the scope of the invention.

What is claimed is:

1. A middle distillate fuel oil composition characterized by its ability to decrease deposit formation in passageways through which it passes which comprises (i) a major portion of a hydrocarbon fuel oil boiling in the middle distillate fuel oil boiling range; and (ii) a minor deposit-inhibiting portion of, as a deposit-inhibiting additive, an ether mono-primary amine of molecular weight $\overline{M}_n$ of 200–400.

2. A middle distillate fuel oil composition as claimed in claim 1 wherein said hydrocarbon fuel oil boiling in the middle distillate fuel oil boiling range is a diesel oil.

3. A middle distillate fuel oil composition as claimed in claim 1 wherein said hydrocarbon fuel oil boiling in the middle distillate fuel oil boiling range is kerosene

4. A middle distillate fuel oil composition as claimed in claim 1 wherein said hydrocarbon fuel oil boiling in the middle distillate fuel oil boiling range is gas oil.

5. A middle distillate fuel oil composition as claimed in claim 1 wherein said additive is present in amount of 100–300 PTB.

6. A middle distillate fuel oil composition as claimed in claim wherein said additive is present in amount of 30–100 PTB.

7. A middle distillate fuel oil composition as claimed in claim 1 wherein said additive is $$R(OCH_2-CH_2)_x-(OCH_2\underset{\underset{CH_3}{|}}{C}H)_yNH_2$$

and R is an alkyl group having 1–40 carbon atoms and x is 0 -20 and y is 0–10 and x +Y is 1–30.

8. A middle distillate fuel oil composition as claimed in claim 1 wherein said additive is $$(C_{10}-C_{12}\text{ alkyl})-(OCH_2\underset{\underset{CH_3}{|}}{C}H)_2NH_2$$

9. A middle distillate fuel oil composition as claimed in claim 1 wherein said additive is $$R(OCH_2\underset{\underset{CH_3}{|}}{C}H)_yNH_2$$

wherein R is an alkyl group having 1–20 carbon atoms and y is 1–10.

10. A middle distillate fuel oil composition as claimed in claim 1 wherein said additive is $$R\ (OCH_2CH_2)_x\ NH_2$$

wherein R is an alkyl group having 1–40 carbon atoms and x is 1–20.

11. A diesel fuel oil composition characterized by its ability to decrease deposit formation in diesel fuel injectors which comprises (i) a major portion of a hydrocarbon fuel oil boiling in the diesel fuel oil boiling range; and (ii) a minor deposit-inhibiting portion of, as deposit-inhibiting additive, $$R(OCH_2-CH_2)_x-(OCH_2\underset{\underset{R^*}{|}}{C}H)_yNH_2$$

wherein

R is an alkyl group having 1–40 carbon atoms;

R* is hydrogen or a lower alkyl group having 1–6 carbon atoms;

x is 0–20; and y is 0–10; and the sum of x and y is 1–30.

12. A diesel fuel oil composition characterized by its ability to decrease deposit formation in diesel fuel injectors which comprises (i) a major portion of a hydrocarbon fuel oil boiling in the diesel fuel oil boiling range; and (ii) a minor deposit-inhibiting portion of 10–300 PTB, of as deposit inhibiting additive of molecular weight $\overline{M}_n$ of 200–400

$$(C_{10}-C_{12})-(OCH_2CH)_2(OCH_2\underset{\underset{CH_3}{|}}{C}H)NH_2$$

13. A middle distillate fuel oil composition characterized by its ability to decrease deposit formation in passage ways through which it passes which comprises (i) a major portion of a hydrocarbon fuel oil boiling in the middle distillate fuel oil boiling range; and (ii) a minor deposit-inhibiting portion of, as the sale deposit-inhibiting additive, an ether mono-primary amine of molecular weight $\overline{M}_n$ of 200–400.

* * * * *

UNITED STATES PATENT AND TRADEMARK OFFICE

CERTIFICATE OF CORRECTION

PATENT NO. : 4,964,879

DATED : October 23, 1990

INVENTOR(S) : Sheldon Herbstman, Kashmir S. Virk

It is certified that error appears in the above-identified patent and that said Letters Patent is hereby corrected as shown below:

Col 3, line 62 cancel "od", insert -- of --;

Col 4, line 37, cancel "lbs/mm", insert -- lbs/min --;

Col 8, line 37, cancel "sale", insert -- sole --.

Signed and Sealed this

Twelfth Day of May, 1992

*Attest:*

DOUGLAS B. COMER

*Attesting Officer*

*Acting Commissioner of Patents and Trademarks*